United States Patent [19]

Schumann

[11] Patent Number: 4,658,731

[45] Date of Patent: Apr. 21, 1987

[54] APPARATUS FOR TRANSPORTING GOODS TO AND FROM SHELVES HAVING DUAL FUNCTION GUIDE ROLLERS

[76] Inventor: Horst G. Schumann, 5190 Stolberg-Zweifall, Werkerbend 28, Fed. Rep. of Germany

[21] Appl. No.: 882,013

[22] Filed: Jul. 3, 1986

Related U.S. Application Data

[63] Continuation of Ser. No. 670,866, Nov. 13, 1984, abandoned.

[30] Foreign Application Priority Data

Nov. 26, 1983 [DE] Fed. Rep. of Germany ..... 3342933

[51] Int. Cl.[4] ..... E01B 25/12; B61L 11/02

[52] U.S. Cl. ..... 104/130; 105/146; 104/121; 104/247

[58] Field of Search ..... 104/121, 120, 119, 130, 104/247; 105/141, 144, 146, 147, 145

[56] References Cited

U.S. PATENT DOCUMENTS

| | | | |
|---|---|---|---|
| 1,602,066 | 10/1926 | Burton | 104/247 X |
| 3,643,600 | 2/1972 | Bertin | 104/130 X |
| 3,643,601 | 2/1972 | Taylor et al. | 105/144 X |
| 3,672,305 | 6/1972 | Richins | 104/130 X |
| 3,680,488 | 8/1972 | Donlon | 104/130 |
| 3,680,489 | 8/1972 | English | 104/291 |
| 3,782,292 | 1/1974 | Metcalf | 104/130 |
| 4,000,700 | 1/1977 | Hannover et al. | 104/130 |
| 4,132,175 | 1/1979 | Miller et al. | 104/130 |
| 4,213,396 | 7/1980 | Mehren et al. | 104/130 |

FOREIGN PATENT DOCUMENTS

| | | | |
|---|---|---|---|
| 571697 | 10/1958 | Belgium | 104/119 |
| 2807984 | 8/1978 | Fed. Rep. of Germany | 104/130 |
| 2100854 | 2/1979 | Fed. Rep. of Germany | 104/130 |

*Primary Examiner*—Robert B. Reeves
*Assistant Examiner*—Scott H. Werny
*Attorney, Agent, or Firm*—W. G. Fasse; D. H. Kane, Jr.

[57] ABSTRACT

An apparatus for transporting goods to and from shelves has a carriage supported frame travelling on inverted T-rails secured to the floor. A vertically extending guide member rides in an overhead U-rail, vertically aligned with the T-rails. The carriage has at least one swivelling axle with wheels travelling on the rails and at least one carriage guiding device with guide rollers guided by an upwardly extending central web of the inverted T-rails except in rail junctions where the central web is omitted. In the rail junctions, guide rails with a U-cross-section take over the guiding of at least one of the guide rollers of each carriage until the central web of the inverted T-rail in the branching rail section takes over the guiding again. Thus, the carriage may be guided selectively into any branching rail section without using railroad type switches nor transfer bridges in the rail system. This construction also avoids the need for separately controllable guiding devices since the guiding of the guide rollers or at least one guide roller is continuous and automatic.

5 Claims, 5 Drawing Figures

APPARATUS FOR TRANSPORTING GOODS TO AND FROM SHELVES HAVING DUAL FUNCTION GUIDE ROLLERS

This application is a continuation of application Ser. No. 670,866, filed Nov. 13, 1984, now abandoned.

FIELD OF THE INVENTION

The invention relates to an apparatus for transporting goods to shelves and for retrieving goods from shelves arranged in parallel rows and including a plurality of shelf tiers.

DESCRIPTION OF THE PRIOR ART

Systems for transporting goods to and from shelves generally comprise carriages with a carriage frame supported by at least one swivellable carriage axle, whereby wheels attached to the swivellable axle travel on guide rails secured to the floor. The guide elements cooperate with guide rail sections arranged in parallel to the rail system which includes branching rail sections interconnected by rail junctions.

Such an apparatus as just described is disclosed in German Patent Publication No. (DE-AS) 2,100,854. In this prior art system at least one guide element guided by a floor rail is attached to the swivellable carriage axle. Additionally, an adjustable guide element is provided which is attachable to a guide rail arranged in parallel to the floor rail along rail junctions interconnecting branching rail sections. The attachment of the additional guide element takes place during the travel of the carriage from section to section.

There is a need to make sure that a transport apparatus of this type does not topple over when shelves or racks are to be supplied with goods or when goods are being retrieved. The required stability of an upright structure supported on a floor carriage for handling the goods must be assured without impairing the ability of the system to select the direction of travel at rail junction points. For these reasons the guide element of the prior art system is coupled to the axle of the carriage running on the floor rail system. Additionally, an overhead rail is arranged in vertical alignment and in parallel to the rails on the floor, whereby a further carriage secured to the upright structure is running along the overhead rail. The overhead carriage also comprises at least one adjustable guide element attachable to an overhead guide rail forming part of the overhead rail structure.

The just described prior art system requires, for its continued operability, the adjustment of the rollers forming the guide elements. This requirement makes it expensive to manufacture such a system. Additionally, this requirement also calls for a continued careful handling of the adjustment of the guide rollers. Additionally, careful maintenance work is required to make sure that the adjustability of the guide elements is always available to keep the guide elements functional for the intended purpose. An unintended blocking or jamming of the guide elements destroys the guide elements and possibly also the guide rails or at least sections thereof when the blocking continues as the apparatus keeps travelling and a further guide element of the same axle is being put in service and when the apparatus is not instantly stopped. In fact, if in the prior art apparatus two guide elements are in action simultaneously, in a rail junction, damage to the carriage axle itself may even occur.

OBJECTS OF THE INVENTION

In view of the above it is the aim of the invention to achieve the following objects singly or in combination:

- to provide an apparatus for transporting goods to and from shelves which is improved by its simple structural features, which is simple in its operation, and which requires a minimum of maintenance work;
- to construct such an apparatus so that it will remain functional even if the operator made an error;
- to improve the guide features of such an apparatus so that even in tight curves of a rail junction the proper guidance of the apparatus is assured;
- to provide a guide feature in front of the front carriage as well as behind the rear carriage to make sure that the apparatus is guided along its entire length in as close as possible an adaptation to the course of the rails on the floor;
- to avoid the use of an overhead carriage;
- to avoid on the carriage guide elements which must be attached to and detached from a guide rail in accordance with the selected travel direction, whereby travelling onto a branch rail can be done merely by steering; and
- to avoid the use of railroad type adjustable junction switches and the use of transfer bridges in the floor rail system

SUMMARY OF THE INVENTION

The system of the invention is characterized by floor rails having an inverted T-configuration with an interrupted upright central web and a continuous flange on which steerable carriage wheels run which are secured to a controllable carriage axle. The upright central web of the floor rails is cut out in rail junctions which interconnect branching rail sections. The rail junctions comprise lateral guide walls for guiding guide elements through the rail junctions where the central web of the inverted T-rail is cut out. The guide elements, such as rollers, which are secured to a carriage are rotatable about vertical shafts. Further, vertical swivel posts permit steering the carriage wheels and guide rollers. Along a straight length of rail track, the guide elements bear against the central upright web of the floor rail and in a junction at least one guide element bears against the lateral upright rail wall. The lateral guide walls in the junctions preferably are part of a curved rail having a U-cross-section so that the lateral walls of the U-rail provide the guiding through the junction.

The inverted T-rail, or rather, the continuous flange of the inverted T-rail, provides a continuous travel surface even in rail junctions. Along straight rail sections the guide rollers which rotate about vertical shafts are guided by the central upright web of the inverted T-rail. In rail junctions, on the other hand, where the central web is cut out, the guide rollers or at least one of these guide rollers is guided by the lateral walls of the guide rails forming the junctions. Since the central web is cut out in these curved rail sections in the junctions, there is no hindrance to the switching of the guide rollers from the straight guiding to the guiding through a curve in a rail junction. This switching takes place only in the rail junctions at the beginning and end of a junction and hence takes place without exception where there is no central upright web. It has been found, surprisingly, that a safe guiding of the travelling wheels of a steerable carriage axle is even assured if there is only one guide roller effective at the time, particularly since the tilting range of the carriage axle is adjustable in accordance with the required radius of the rail junction by control means known as such.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 3:
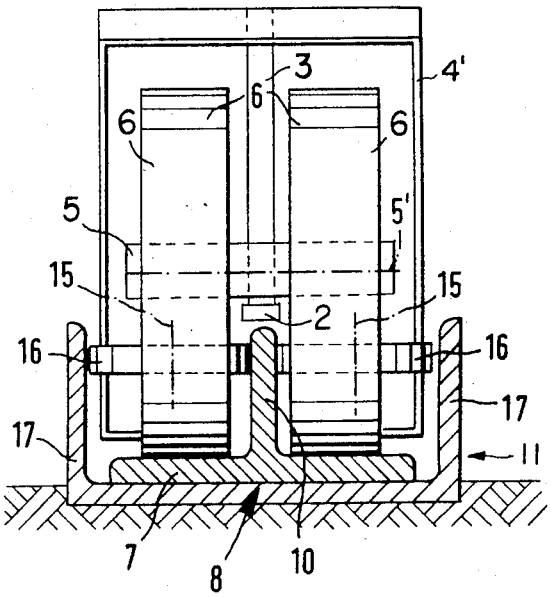
FIG. 3 is a view, partially in section, substantially along section line 3—3 in FIG. 1, however omitting the carriage frame to simplify the illustration.
Figure 4:
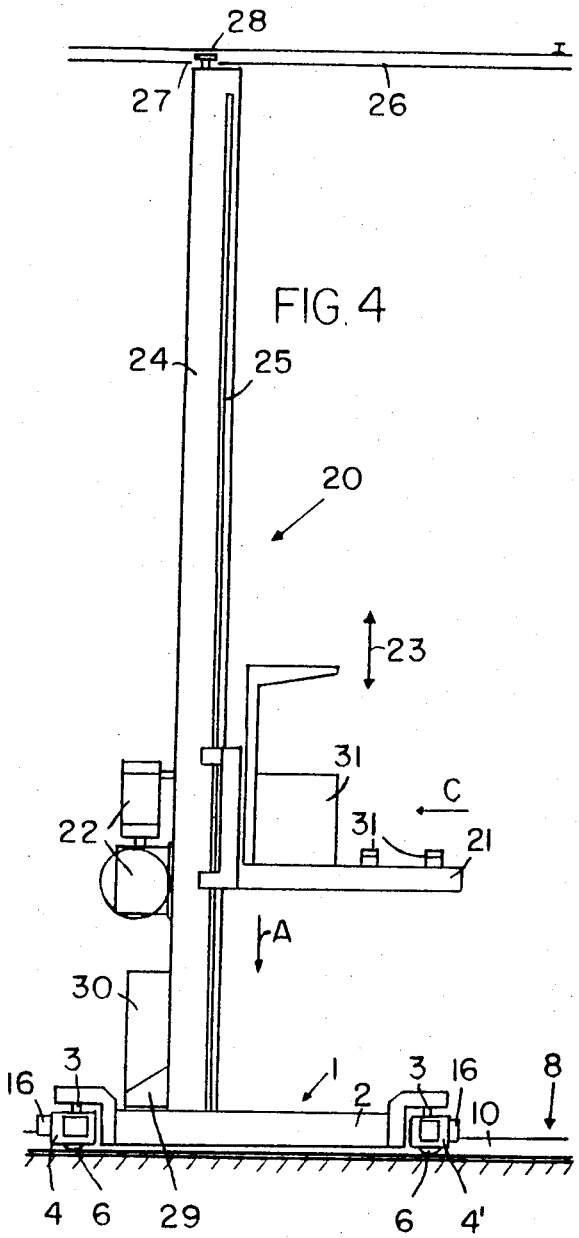
FIG. 4 is a side view of the present apparatus approximately in the direction of the arrow B in FIG. 1.
Figure 5:
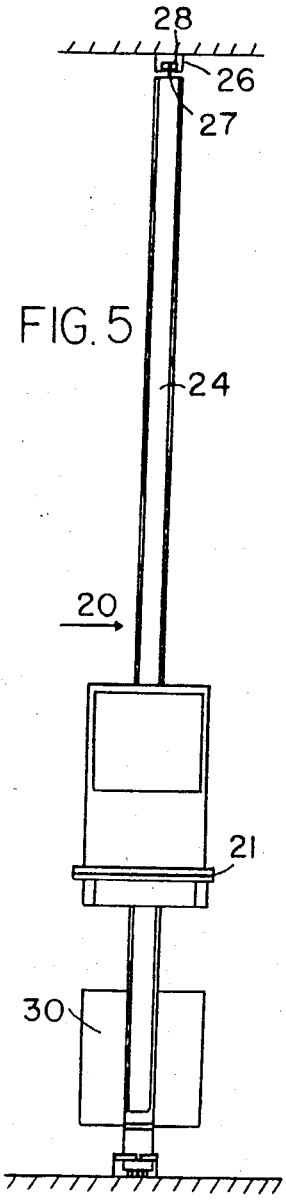
FIG. 5 is a view approximately in the direction of the arrow C in FIG. 4.

FIG. 4 shows an overall side view of the present apparatus for transporting goods to and from shelves and FIG. 5 is a simplified view in the direction of arrow C in FIG. 4. The shelves are not shown since they are not part of the invention, however, such shelves would be arranged, for example, to the right and left of the apparatus shown in FIG. 5 and behind and in front of the apparatus as shown in FIG. 4. The present apparatus includes a conveying vehicle 1 including a carriage frame 2 supported at one end thereof by a first or front carriage 4 and at the other end thereof by a second or rear carriage 4'. Each carriage has wheels 6 secured to a horizontally extending carriage axle 5 having an axis 5', both shown by dash-dotted lines in FIGS. 1, 2, and 3. The carriage axles 5 in turn are secured to the carriage frame 2. At least one carriage axle 5 is secured to the carriage frame 2 by a vertical swivel post 3, preferably, both carriage shafts 5 are secured through a swivel post 3 so that both carriages 4 and 4' can swivel about the respective swivel post 3.

The conveying vehicle 1 travels on a track 8 having an inverted T-cross-section with an upright central web 10 as will be described in more detail below. The web 10 guides guide rollers 16 except where the web 10 is omitted in the rail junctions as will also be described below.

A transport mechanism 20 is mounted to the carriage frame 2 by a mounting foot 29. The transport mechanism 20 comprises an upright post 24 reaching from the carriage 2 to the overhead rail 26 mounted to the ceiling in vertical alignment and in parallel to the rail or track system 8 attached to the floor. The upright post 24 carries at its top a guide rod 27 which in turn is provided with an overhead guide roller 28 running in the overhead guide rail 26 preferably of U-shaped configuration forming a downwardly open guide channel for the overhead guide roller 28. The upright post 24 carries a platform 21 for handling goods 31 to be brought to the shelves or retrieved from the shelves. An operator will move the goods manually from shelf to platform and vice versa. The platform 21 is supported, for example, by a chain or cable drive 25 of conventional construction for moving the platform up and down as shown by the arrow 23. Power for this purpose may be derived, for example, from a battery pack 30 operating an electric motor and gear system 22 in the same manner as is the case in conventional forklifts. Therefore, the drive means will not be described in further detail.

Figure 1:
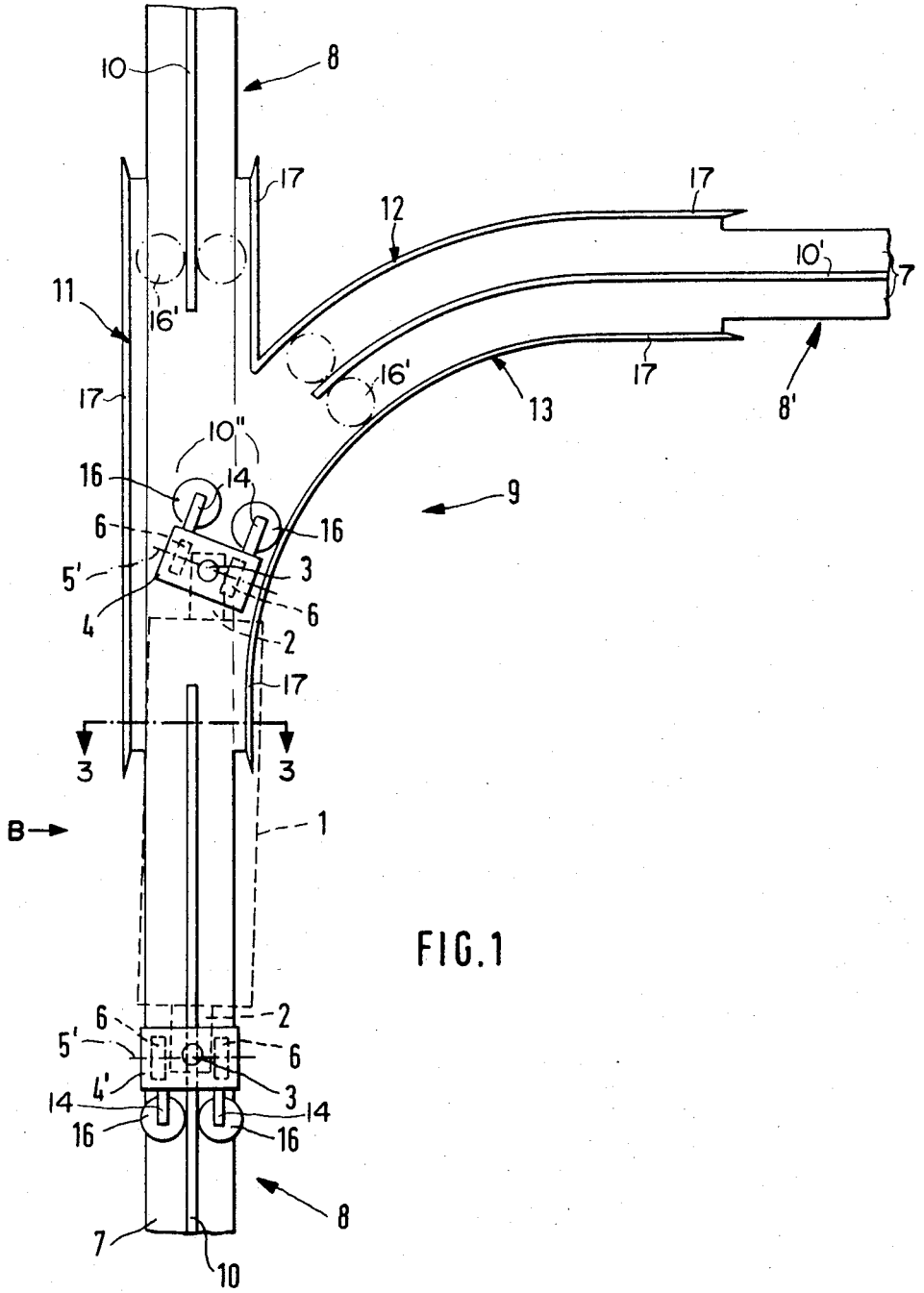
FIG. 1 is a top plan view onto a rail and transport system according to the invention as viewed in the direction of the arrow A in FIG. 4, whereby the carriage is provided with two tiltable carriage axles, one of which is still located on a straight rail section, whereas the other is about to follow a curved rail section into a rail junction leading into a branching rail section.

The top plan view of FIG. 1 shows a main rail or track 8 attached to the floor and having a cross-sectional inverted T-configuration as best seen in FIG. 3. A branching rail section 8' merges into the main rail or track 8 in a rail junction 9 to be described in more detail below.

The conveying vehicle 1 with its carriage frame 2 and carriages 4, 4' travels on these rails 8, 8', whereby the carriage wheels 6 travel on the upwardly facing surface of the flange 7 of the rails 8, 8'. As mentioned, the wheel axles 5 can swivel about the vertical swivel posts 3. The entire conveying vehicle with its super structure may be conventionally driven by supplying power to the wheels 6 or the system may be pushed by an operator from shelf to shelf.

The central upright web 10, 10' of the rails 8, 8' is omitted in the rail junctions 9 as shown at 10''. The guiding of the guide rollers 16 to be described in more detail below is accomplished in the rail junctions by guide rail sections 11, 12 and 13 which provide vertically upright guide walls 17 in the rail junctions 9.

Figure 2:
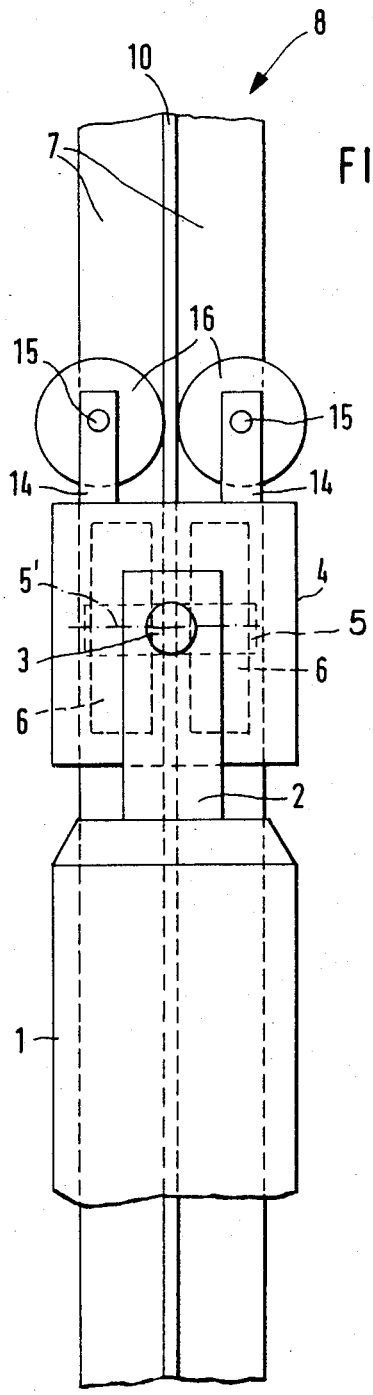
FIG. 2 shows on an enlarged scale a top plan view of a portion of FIG. 1 along a straight rail section.

The guide rollers 16 are secured to the respective carriage 4, 4' by mounting arms 14 extending forward of the first or front carriage 4 and rearward of the rear or second carriage 4'. The mounting arms 14 carry vertical shafts 15 which support the guide rollers 16 in a rotatable manner for travelling along the web 10, 10' as best seen in FIG. 2 along the rails 8, 8' outside the junctions 9.

On the other hand, when a carriage negotiates a junction 9, at least one roller 16 is guided by the respective upright wall 17 of the junction forming rail members 11, 12, 13. The rail sections 11, 12, 13 providing the guide walls 17 are so arranged, that there is some overlap between the guide walls 17 and the respective upright central web 10, 10'. In these areas the spacing between the inner surface of the walls 17 and the respective web surface of the web 10, 10' is larger than the maximal diameter of the guide rollers 16 so that the rollers are always able to rotate rather than to slide. A very small difference in the roller diameter of the rollers 16 and the just mentioned spacing between the walls 17 and the webs 10, 10' is sufficient to assure a continuous rolling movement rather than a sliding movement of the guide rollers 16.

FIG. 3 shows the slight spacing between the roller surface of the guide rollers 16 and the adjacent surface of the guide walls 17.

Depending on the tilted or straight position of the carriage 4 which may be controlled by the operator, the conveying vehicle 1 will travel into the branch rail 8' or it will continue on the straight rail 8. In any event, at least one guide roller will be in contact with the guide wall 17 in the webless part 10'' of the junction 9. As soon as the webless part 10'' has been passed, both rollers will again be guided by the central web as indicated in dash-dotted lines at 16'.

As shown in FIG. 3, the guide rail sections 11 or 12 or 13 are preferably provided in the form of rails having a U-cross-section with the web secured to the floor, preferably in a recessed manner so that the flange 7 of the rails 8, 8' can run directly along the inner surface of the web of the U-rails 11, 12, 13 as shown in FIG. 3, thereby maintaining its horizontal disposition. However, the walls 17 need not be part of a U-rail if desired.

In the shown example embodiment both carriages 4, 4' are equipped with swivellable carriage axles 5. This feature has the advantage that the rear wheels 6 will not cut a curve in the rail junction 9 especially if both axles 5 are controllable by their own pair of guide rollers as illustrated. This feature assures a proper guiding even in relatively narrow curves leading into a rail junction 9.

It is further evident from FIG. 1 that the longitudinal spacing from the front set of guide rollers 16 to the rear set of guide rollers is larger than the respective spacing from axle 5 to axle 5, whereby the front guide rollers 16 lead the front carriage 4 while the rear guide rollers 16 trail the rear carriage 4'. This feature has the advantage that the entire guiding of the conveying vehicle 1 is adapted as much as possible along its entire length to the contour of the rails.

The above mentioned overhead guide roller 28 is substantially simpler than the prior art overhead guide carriage. Accordingly, the roller 28 with its guide rod 27 is substantially less expensive, yet assures a proper overhead guiding of the upright post 24 which is stiff against torque loads.

The features of the invention assure a proper support and guiding of the entire conveying vehicle with its super structure without impairing the operator's ability of selecting the desired travel direction at rail junctions 9 even if these junctions have narrow curves. The invention achieves these features without requiring guide elements which rotate about axles requiring to be selectively attached or tilted toward and tilted away from guide rails depending on the desired travel direction.

The invention does not require any railroad type switching devices in the junctions 9 on the floor. However, it is desirable to provide the overhead rail 26 with a railoaod type switch at the junctions for properly guiding the roller 28. The invention also does not require any junction bridging devices. Thus, the rail system according to the invention virtually does not have any moving parts in the floor portion of the system and only simple movable switch tongues in the overhead portion of the rail system for the roller 28.

Although the invention has been described with reference to specific example embodiments, it will be appreciated, that it is intended, to cover all modifications and equivalents within the scope of the appended claims.

What is claimed is:

1. An apparatus for transporting goods to and from shelves, comprising a vehicle including a carriage frame, goods handling means mounted on said carriage frame, a front guide carriage including a swivel type front carriage axle and front support wheels (6) secured to said swivel type front carriage axle, a vertical swivel post (3) securing said swivel type front carriage axle (5) to said carriage frame in a swivelling manner, a rear guide carriage including a swivel type rear carriage axle and a further vertical swivel post securing said swivel type rear carriage axle to said carriage frame, rear support wheels (6) secured to said swivel type rear carriage axle, front and rear guide rollers (16) operatively secured to said front and rear guide carriages for guiding the respective swivel axle, a pair of front guide rollers and a pair of rear guide rollers, vertical rotational shafts for operatively securing said pairs of front and rear guide rollers to said front and rear support wheels having a horizontal axis, rail means including straight rail sections and rail junctions, said straight rail sections having an inverted T-cross-section with a continuous flange (7) and an upright central web (10) connected to a floor alongside said shelves, said rail junctions having a straight portion and a curved portion for interconnecting said straight rail sections, said upright central web (10) being interrupted in said rail junctions, said front and rear support wheels travelling on said continuous flange of said rail means, said rail junctions (9) comprising lateral upright guide walls (17), said vertical rotational shafts being secured to the respective front and rear guide carriage for supporting said pairs of guide rollers (16), arranged such that both rollers of a pair contact said central upright web (10) for guidance when travelling along said straight rail sections (7) and only one guide roller (16) of a pair contact said lateral upright guide walls (17) for guidance when travelling through said rail junctions (9) where said central upright web (10) is interrupted, whereby said guide rollers (16) are dually effective in accordance with the swivelling of the respective guide carriage in said straight rail sections and in said rail junctions, thereby avoiding guide elements which must be attached to and detached from a guide rail.

2. The apparatus of claim 1, further comprising first mounting means projecting forwardly from said front guide carriage for mounting said front guide rollers, and second mounting means projecting rearwardly from said rear guide carriage for mounting said rear guide rollers, whereby said pairs of guide rollers are spaced from each other a distance larger than a spacing between said front and rear swivel type carriage axles carrying said front and rear support wheels.

3. The apparatus of claim 1, wherein said handling means mounted on said carriage frame comprise an upright structure, a vertically extending guide member mounted on said upright structure, said rail means further comprising an overhead U-rail arranged in vertical alignment with said rail means on said floor for providing an overhead guide channel for said vertically extending guide member.

4. The apparatus of claim 3, further comprising an overhead guide roller carried by said vertically extending guide member for riding in said overhead guide channel.

5. The apparatus of claim 1, wherein said rail junctions comprise rail sections having a U-cross-section for providing said lateral upright rail walls for guiding said guide rollers through said rail junctions.

* * * * *

UNITED STATES PATENT AND TRADEMARK OFFICE

CERTIFICATE OF CORRECTION

PATENT NO. : 4,658,731

DATED : April 21, 1987

INVENTOR(S) : Horst G. Schumann

It is certified that error appears in the above-identified patent and that said Letters Patent is hereby corrected as shown below:

Claim 1, column 6, line 6, after "axle," delete the rest of the line;

line 7, delete the entire line;

line 8, delete "the respective swivel axle,"

line 9, after "rollers" insert --(16)--;

line 11, after "to" insert --said front and rear guide carriages respectively for guiding the respective swivel axle,--;

line 28, replace "contact" by --contacts--.

Signed and Sealed this

First Day of September, 1987

*Attest:*

*Attesting Officer*

DONALD J. QUIGG

*Commissioner of Patents and Trademarks*